US008603408B2

(12) United States Patent
Sanville et al.

(10) Patent No.: US 8,603,408 B2
(45) Date of Patent: Dec. 10, 2013

(54) APPARATUS FOR CONTROL OF ON SITE MIXING OF SOLID PEROXIDE SOURCE AND CATALYST

(75) Inventors: Katherine M. Sanville, White Bear Lake, MN (US); John E. Thomas, River Falls, WI (US)

(73) Assignee: Ecolab USA Inc., Saint Paul, MN (US)

( * ) Notice: Subject to any disclaimer, the term of this patent is extended or adjusted under 35 U.S.C. 154(b) by 92 days.

(21) Appl. No.: 13/161,853

(22) Filed: Jun. 16, 2011

(65) Prior Publication Data

US 2012/0320706 A1 Dec. 20, 2012

(51) Int. Cl.
*B01F 1/00* (2006.01)
*B01F 5/20* (2006.01)

(52) U.S. Cl.
USPC ..... 422/264; 366/177.1; 366/178.1; 366/181.1; 366/181.2; 422/274

(58) Field of Classification Search
CPC ..... B01F 15/02
USPC ..... 366/177.1, 178.1, 181.1, 181.2, 183.2; 422/263, 264, 274, 261
See application file for complete search history.

(56) References Cited

U.S. PATENT DOCUMENTS 2,288,791 A * 7/1942 Culliton ..... 422/119
2,308,612 A * 1/1943 Lehmkuhl ..... 422/274
2,726,939 A * 12/1955 Andrews ..... 554/10
2,738,323 A * 3/1956 Tepas, Jr. ..... 422/274
3,595,438 A * 7/1971 Daley et al. ..... 222/67
4,063,663 A 12/1977 Larson et al.
D248,103 S 6/1978 Larson et al.
4,426,362 A 1/1984 Copeland et al.
4,687,121 A * 8/1987 Copeland ..... 222/64
4,690,305 A * 9/1987 Copeland ..... 222/52
RE32,763 E * 10/1988 Fernholtz et al. ..... 510/225
RE32,818 E * 1/1989 Fernholz et al. ..... 510/225
4,826,661 A * 5/1989 Copeland et al. ..... 422/106
4,999,124 A 3/1991 Copeland
5,384,102 A * 1/1995 Ferguson et al. ..... 422/264

(Continued)

OTHER PUBLICATIONS

"Installation and Operation Manual" "Universal Detergent Reservoir", 1982 Economics Laboratory, Inc., 16 pages.

(Continued)

*Primary Examiner* — David Sorkin
*Assistant Examiner* — Abbas Rashid
(74) *Attorney, Agent, or Firm* — McKee, Voorhees & Sease, P.L.C.

(57) ABSTRACT

An apparatus for controlling on site generation and mixing of a two or more part chemistry, such as a peroxide source and a catalyst. In particular, the invention discloses an apparatus and dispensing method for separating solid surfaces that undergo an uncontrolled, continuous reaction when contacted with water and allows for delivery of solid reactive chemistries at the same time in a standard spray from the bottom dispensing configuration while preventing continued reaction after the dosing is complete.

18 Claims, 5 Drawing Sheets

(56) References Cited

U.S. PATENT DOCUMENTS

| | | | | |
|---|---|---|---|---|
| 5,759,501 | A | 6/1998 | Livingston et al. | |
| 5,882,512 | A * | 3/1999 | Denkewicz et al. | 210/167.11 |
| 6,007,788 | A * | 12/1999 | Bellon et al. | 422/264 |
| 2002/0186614 | A1 * | 12/2002 | Millward | 366/167.1 |
| 2003/0168085 | A1 * | 9/2003 | Sowle et al. | 134/25.2 |
| 2004/0226961 | A1 * | 11/2004 | Mehus et al. | 222/77 |
| 2006/0162809 | A1 * | 7/2006 | Thomas et al. | 141/95 |
| 2007/0068769 | A1 * | 3/2007 | Cymerman et al. | 196/14.52 |
| 2007/0154370 | A1 * | 7/2007 | Mehus et al. | 422/257 |
| 2007/0253876 | A1 * | 11/2007 | Limback et al. | 422/266 |
| 2010/0084290 | A1 * | 4/2010 | Anson et al. | 206/219 |

OTHER PUBLICATIONS

Ecolab USA Inc., et al., PCT/IB2012/052921, filed on Jun. 8, 2012, "The International Search Report and the Written Opinion of the International Searching Authority, or the Declaration", mail date Feb. 19, 2013.

* cited by examiner

APPARATUS FOR CONTROL OF ON SITE MIXING OF SOLID PEROXIDE SOURCE AND CATALYST

FIELD OF THE INVENTION

The invention relates to an apparatus suitable for controlling on site mixing of a two part chemistry having a peroxide source in one part and a catalyst or other source in a second part. In particular, the invention discloses an apparatus and dispensing method for separating solid surfaces that when wet and in contact undergo an uncontrolled, continuous reaction.

BACKGROUND OF THE INVENTION

The use of solidification technology is often used to generate solid block detergents and other chemistries in institutional and industrial operations. Often solidification is used by casting a melted composition, by extrusion and/or pressing by applying high pressures to generate the desired solid block formulation. These and other solidification technologies require expensive equipment and advanced technical know-how.

Solidification technologies can be used for a variety of solid chemistries. Depending upon the formulation of the solid chemistries there may be a need to separate a two or more part chemistry into more than one solid formulations. For certain chemistries there is a further need to separate solid formulations by multiple inputs that feed or dispense from a single product source outlet or a single fluid outlet. Accordingly, it is an objective of the claimed invention to develop an apparatus for dispensing solid chemistries having multiple inputs to maintain separate handling of the reactive chemistries until the solids are contacted by a water source for dispensing from a single outlet.

BRIEF SUMMARY OF THE INVENTION

An advantage of the invention is the separation of two part chemistry where the delivery of two solid reactive chemistries is dispensed at the same time from a single dispensing configuration. For example, a solid chemistry of a peroxide source and a catalyst may be dispensed from a single, solid chemistry source. It is an advantage of the present invention that any type of solid formulation may be dispensed according to the apparatus design and function.

The present invention relates to an apparatus for control of on-site mixing of at least a first product and a second product. The apparatus can include a base having an outer support member and an aperture therethrough, a screen attached to the base and substantially covering the base aperture, a first chamber positioned at the base aperture, the first chamber having a first open end extending generally upward from the screen, an opposite second open end extending generally downward from the screen, and a chamber body therebetween.

The present invention further relates to an apparatus for control of on-site mixing of at least two solid chemistry products. The apparatus can include a base having an outer support member and an aperture therethrough, a screen attached to the base and substantially covering the base aperture, a first chamber positioned at the base aperture, the first chamber having a first open end extending generally upward from the screen and housing a first solid chemistry product, an opposite second open end extending generally downward from the screen; and a chamber body therebetween, and a second solid chemistry product housed in the area around the first chamber, wherein said first and second solid chemistry products are selected from the group consisting of a peroxide source, enzymes, catalysts and combinations of the same.

According to the embodiments of the invention the apparatus is constructed such that the first chamber is configured to fluidly seal the area within the first chamber from the area outside the first chamber, such that when a water source is applied across the screen the first solid chemistry product dissolved does not come into contact with the second solid chemistry product until the second solid chemistry product is also dissolved and both products cross through the screen into a dispensing spout.

The present invention further relates to methods of on-site mixing of a two part solid chemistry product. The methods of on-site mixing include the step of contacting a water spray onto a surface of a first and a second solid chemistry product. According to the invention the first and second solid chemistry products are housed within an apparatus for controlling on-site mixing, said apparatus comprising: a base having an outer support member and an aperture therethrough, a screen attached to the base and substantially covering the base aperture, a first chamber positioned at the base aperture, the first chamber having a first open end extending generally upward from the screen and housing a first solid chemistry product, an opposite second open end extending generally downward from the screen, and a chamber body therebetween. The second solid chemistry product is housed in the area around the first chamber, wherein said first and second solid chemistry products are selected from the group consisting of a peroxide source, enzymes, catalysts and combinations of the same.

In some embodiments, the method includes on-site mixing wherein the surfaces of the first and second solid chemistry products contacted with the water spray are not in contact with one another until the first and second solid chemistry products are dissolved to form a concentrated use solution. Thereafter, the method may further include dispensing a concentrated use solution to a point of use or a storage reservoir and optionally including the step of diluting the concentrated use solution.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
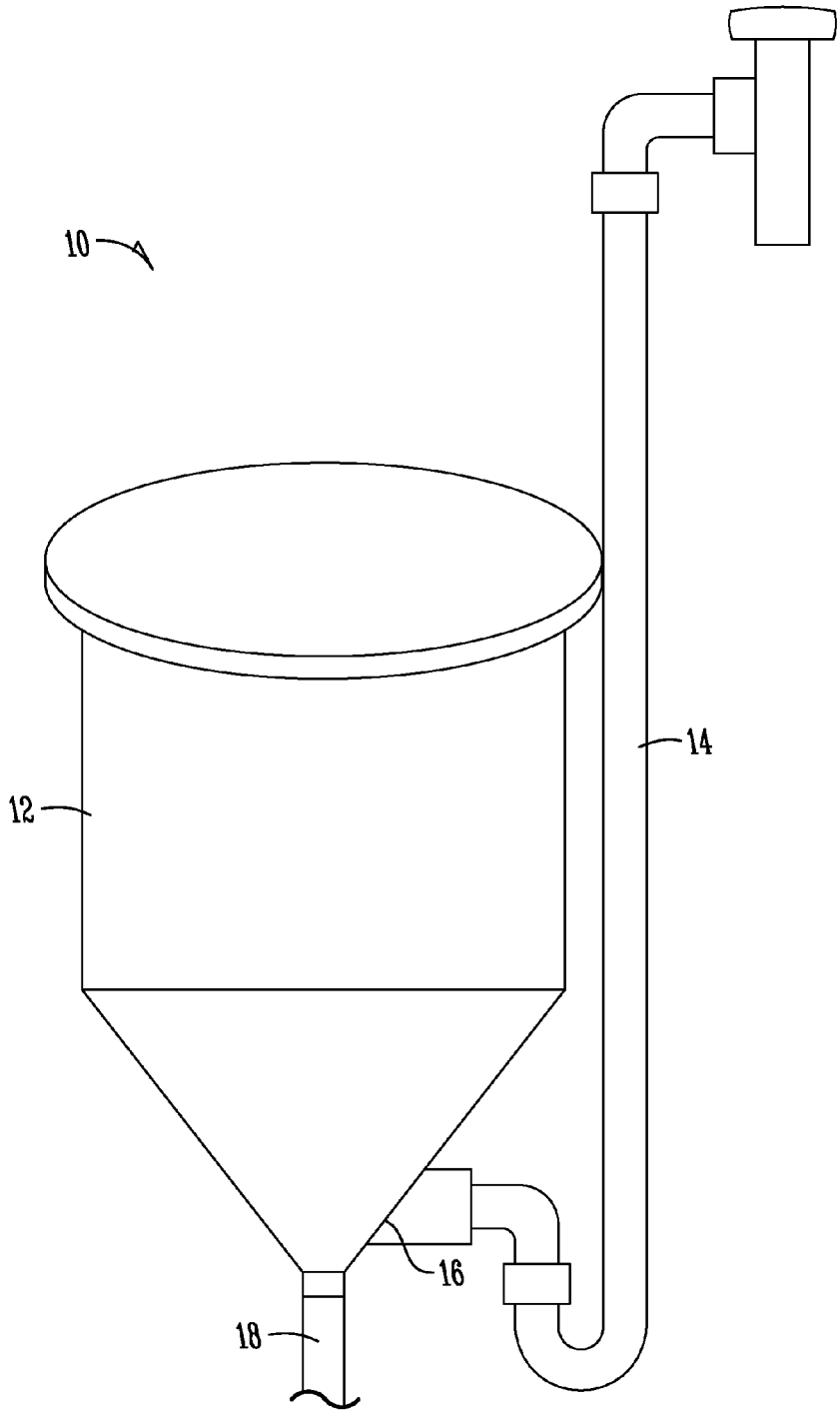
Fig. 1 (PRIOR ART)
FIG. 1 is a perspective view of a detergent dispensing system.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

The present invention relates to an apparatus and methods of use for separating two or more solid chemistries to limit contact between the chemistries for controlled reactions at a time of dispensing a use solution. The apparatus and methods of use have many advantages over traditional dispensing systems, as a result of the apparatus design separating solid surfaces from contacting another and controlling dissolution of the solid surfaces according to a desired formulation of a use solution. For example, a peroxide source and a catalyst provide a desirable combined use solution with bubbling for enhanced cleaning action. However, upon contact with a water source, the solid surfaces of a peroxide source and a catalyst react in an uncontrolled manner, resulting in significant waste of material. The present invention allows for delivery of two or more solid reactive chemistries at the same time in a standard spray from the bottom dispensing configuration while preventing continued reaction after the dosing is complete.

The embodiments of this invention are not limited to particular apparatuses for dispensing and/or methods of use, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities refers to variation in the numerical quantity that can occur.

The term "cleaning," as used herein, refers to performing or aiding in soil removal, bleaching, microbial population reduction, or combination thereof.

The term "catalyst," as used herein, refers to an agent, such as transition metals, used to activate hydrogen peroxide or a source of oxygen. According to an embodiment of the invention, the activation of hydrogen peroxide or an oxygen source may include the decomposition of a peroxide source for improved bleaching activity and bubbling of a use solution for enhanced cleaning requiring minimal mechanical effort.

The terms "functional material" or "functional additives" refer to an active compound or material that affords desirable properties to the solid or dissolved composition. For example, the functional material can afford desirable properties to the solid composition such as enhancing solidification characteristics or dilution rate. The functional material can also, when dissolved or dispersed in an aqueous phase, provide a beneficial property to the aqueous material when used. Examples of functional materials include chelating/sequestering agent, alkalinity source, surfactant, cleaning agent, softening agent, buffer, anti-corrosion agent, bleach activators secondary hardening agent or solubility modifier, detergent filler, defoamer, anti-redeposition agent, antimicrobials, rinse aid compositions, a threshold agent or system, aesthetic enhancing agent (i.e., dye, perfume), lubricant compositions, additional bleaching agents, functional salts, hardening agents, solubility modifiers, enzymes, other such additives or functional ingredients, and the like, and mixtures thereof. Functional materials added to a composition will vary according to the type of composition being manufactured, and the intended end use of the composition.

The terms "solid" or "solid cleaning composition," as used herein, refer to a cleaning composition in the form of a solid, including, but not limited to a waxy powder, a flake, a granule, a powder, a pellet, a tablet, a lozenge, a puck, a briquette, a brick, a solid block, or a unit dose. In addition, the term "solid" refers to the state of the cleaning composition under the expected conditions of storage and use of the solid cleaning composition. In general, it is expected that the cleaning composition will remain in solid form when exposed to temperatures of up to about 100° F. and greater than about 120° F.

The apparatuses and methods of dispensing according to the present invention may comprise, consist essentially of, or consist of the component and steps of the present invention as well as others described herein. As used herein, "consisting essentially of" means that the apparatuses and methods may include additional steps or components, but only if the additional steps, components or ingredients do not materially alter the basic and novel characteristics of the claimed methods and apparatuses.

Apparatus

FIG. 1 is a depiction of a dispensing system 10, such as a detergent dispensing system. Such dispensing systems are generally known and exemplary spray-type dispensers are disclosed for example in U.S. Pat. Nos. 4,826,661, 4,690,305, 4,687,121, 4,426,362 and in U.S. Pat. Nos. Re 32,763 and 32,818, the disclosures of which are incorporated by reference herein. The system 10 is designed to convert a solid warewashing detergent, such as pellets, granules, powders or the like, into high strength liquid for dispensing into a wash tank of a particular washing machine. The system 10 includes a reservoir 12 for holding the detergent, a water line 14 connected to the reservoir 12 through a water line aperture 16, a nozzle 60 at the end of the water line 14, and a dispensing or output spout 18 at the bottom portion of the reservoir 12. According to an embodiment, the reservoir comprises a heavy duty plastic.

According to an embodiment of the invention, a water line 14 and nozzle 68 are used to spray water onto a first product 60, or a first product and/or a second product 62. The first and second products 60, 62 are cleaning chemistries that are activated by water. For instance, one product may be peroxide and the other a catalyst. However, it should be appreciated that many products are contemplated for use with the present invention, such as the various chemistries disclosed herein.

Figure 2:
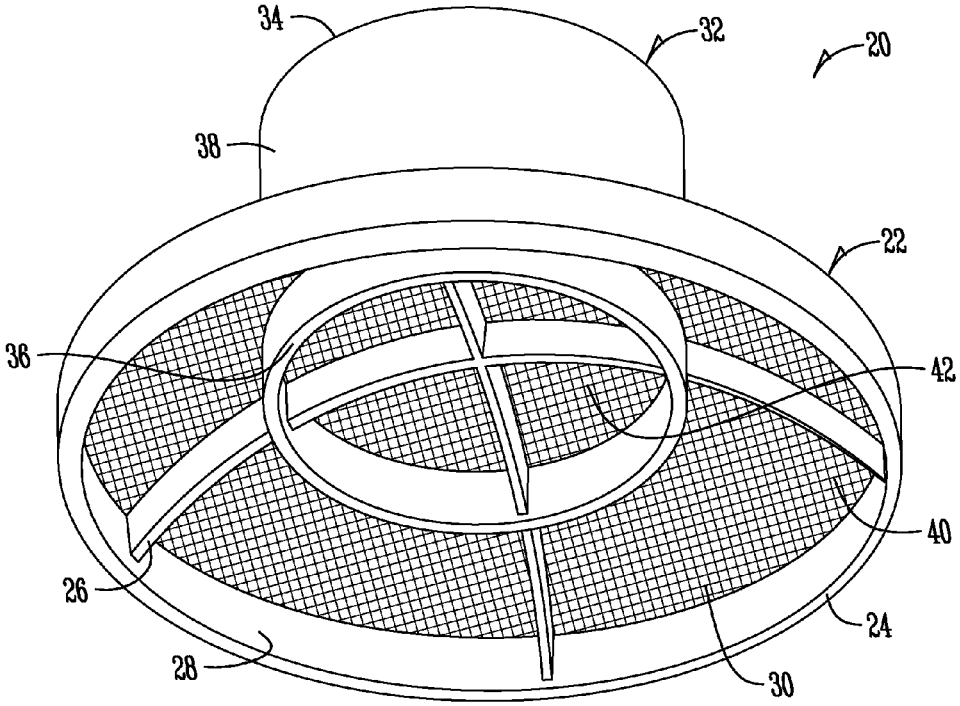
FIG. 2 is a perspective view of an apparatus for controlling mixing of products used with the detergent dispensing system of FIG. 1 according to the present invention.

FIG. 2 is a perspective view of an apparatus 20 used in conjunction with the dispensing system 10 of FIG. 1 for controlling mixing of chemistry products. The apparatus 20 is sized to fit within the reservoir 12 of the system 10. The apparatus 20 includes a base 22, a screen 30, and at least one chamber 32. The base 22 comprises an outer support member 24 forming an outer wall with a general aperture 28 therethrough. As shown in FIG. 2, the base 22 may also contain a plurality of inner support members 26 that extend from one location on the outer support member 24 to another location. The inner support members 26 give the apparatus 20 a certain shape, as well as an increased strength.

According to an embodiment of the invention, the base 22 is comprised of a polypropylene or another rigid or plastic material. The base 22 may be formed by extruding, molding, or otherwise forming the plastic or rigid material into the size and shape required for the use. For instance, if the apparatus 20 is to be used with different dispensing systems 10, the size and shape may need to be adjusted to allow it to fit within the specific reservoir 12. While the base 22 is shown to be generally a circular shape in the figures, it should be appreciated that other shapes could be used. In addition, while the inner support members 26 form the base 22 into a generally dome shape in the figures, it is also contemplated that the base 22 may be flat or shaped in an inverted dome shape where the center is lower than the outer support member 24.

The screen 30 is configured to fit within the outer support member 24 of the base 22. Additionally, the screen 30 is shaped to follow the general shape of the inner support members 26. As shown in the figures, the screen 30 forms a general dome shape with the base 22. However, as mentioned above regarding the shape of the base 22, the screen 30 may take any shape and be any size necessary for the specific application of the dispensing of a solid chemistry and the particular dispensing system 10. The screen 30 is comprised of stainless steel (e.g. 316 SS) in a preferred embodiment. However, other types of screens and materials used to make screens should be considered a part of the present invention as one of skill in the art shall appreciate based upon the disclosure herein. In addition, the present invention contemplates that the screen 30 may be of any number of mesh sizes. The density of criss-crossing material used to make the screen determines the mesh size. According to an embodiment of the invention the mesh size for the screen 30 is about 24×24 with a wire diameter of about 0.014 inches and a width of opening of about 0.028 inches. The percentage of open area is approximately 44.2%. A screen 30 having an approximately 0.0165 inch opening with an approximately 0.012 inch wire diameter is also contemplated. The particular size of the screen and wire diameters will be chosen based on the products used with the apparatus. Therefore, the present invention further contemplates the use of screens having mesh sizes different than the particular dimensions listed, and the exact size of the mesh of the screen is not to be limiting to the present invention. Finally, the screen 30 may comprise multiple portions 40, 42 that have different mesh sizes, but that are attached to one another to form one complete screen.

The chamber 32 is used to separate multiple products within the reservoir 12. The chamber 32 also comprises a plastic or other rigid material. Therefore, the base 22 and chamber 32 may be extruded or formed all as one piece, or it may be done in pieces. The chamber 32 includes a first open end 34, an opposite second open end 36, and a chamber body 38 therebetween. As shown in FIG. 2, according to one embodiment of the invention the chamber 32 is a hollow cylinder. However, other shapes may be used and are considered a part of the present invention. The first end 34 of the chamber 32 extends generally upwardly from the screen 30 and inner support members 26 of the base 22. The second open end 36 of the chamber 32 extends generally downwardly from the screen 30 and inner support members 26. This creates a barrier, both above and below the screen, between the area within the chamber 32 and the area around the chamber, which allows the use of one product within the chamber and another product outside the chamber without the possibility of the two products being in physical contact (thereby preventing any chemical reaction with one another). Furthermore, the chamber may include a chamber lid 64 to close the first open end 34 of the chamber 32.

As stated above, the chamber 32 may be formed along with and as part of the base 22. In this particular method of manufacture, the screen 30 would then be sized and fit within the areas of the base 22 and chamber 32. The screen may be glued or otherwise attached to the base. However, this may be time consuming, as there would be multiple portions of screen that would need to be attached to the base 22 and chamber 32. Therefore, in another method of manufacture, the base 22, first end 34, and second end 36 may be formed or extruded separately. With this method, one piece of screen 30 would be able to be placed over the inner support members 26 of the base 22. Then, the first end 34 of the chamber 32 and the second end 36 of the chamber 32 would be attached to one another and the screen 30 and base 22 to fluidly seal the area within the chamber 32 from the area outside the chamber. With this method, the chamber 22 would also include a third open end and a fourth open end attached to one another.

The present invention also contemplates that the length from the first open end 34 to the second open end 36 of the chamber be adjustable, as may be required for some uses. Therefore, threaded portions or other adjustable means that allow the second end 36 to translate different lengths from the first end 34 may connect the second open end 36 to the first open end 34.

Figure 3:
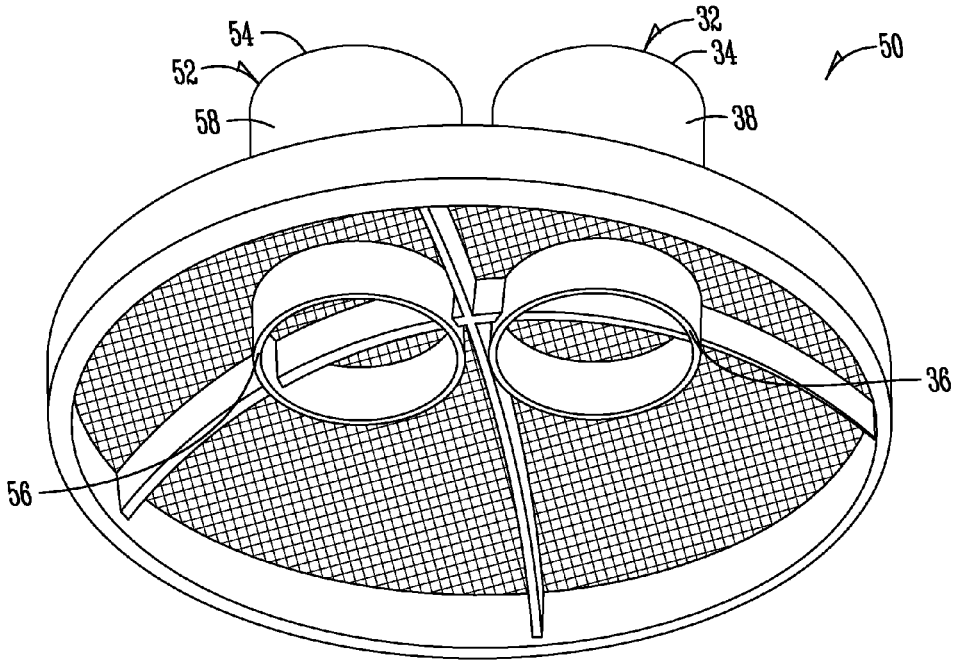
FIG. 3 is a perspective view of another embodiment of an apparatus used with the detergent dispensing system of FIG. 1.

FIG. 3 shows another embodiment of the apparatus 50 used in conjunction with a dispensing system 10 according to the present invention. The apparatus 50 shown in FIG. 3 is similar to the one shown in FIG. 2, except for the addition of a second chamber 52 included for use with the first chamber 32. The second chamber 32 includes a first open end 54, an opposite second open end 56, and a second chamber body 58 therebetween. The first open end 54 extends generally upwardly from the screen 30, while the second open end 56 extends generally downwardly from the screen 30 to create a wall or barrier both above and below the screen 30. The barrier will help ensure that products inside the chamber 52 do not contact and react with products outside the chamber. The use of multiple chambers allows the dispensing system 10 to include more than two solid chemistries. For instance, a first product may be placed within the first chamber, a second product can be placed within the second chamber, and a third product can be placed in the area around the first and second chambers. In addition, even more chambers may be added to house as many different products as is desired for a specific application according to the invention. As stated above, the multiple chambers may be formed or extruded along with the base to form one complete piece, or the chambers may be formed separately, and attached to the base at a later time. In addition, a different sized screen mesh may be used in the apparatus 50 in conjunction with the three different products.

Figure 4:
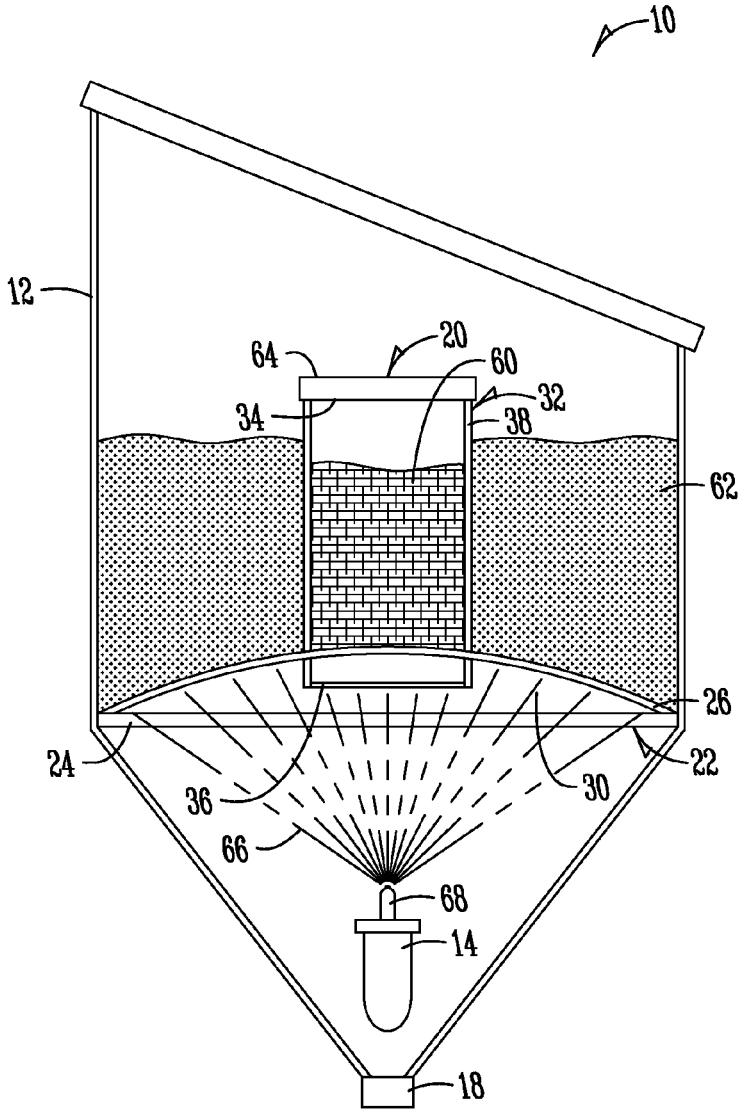
FIG. 4 is a sectional view of a detergent dispensing system using the apparatus of FIG. 2.
Figure 5:
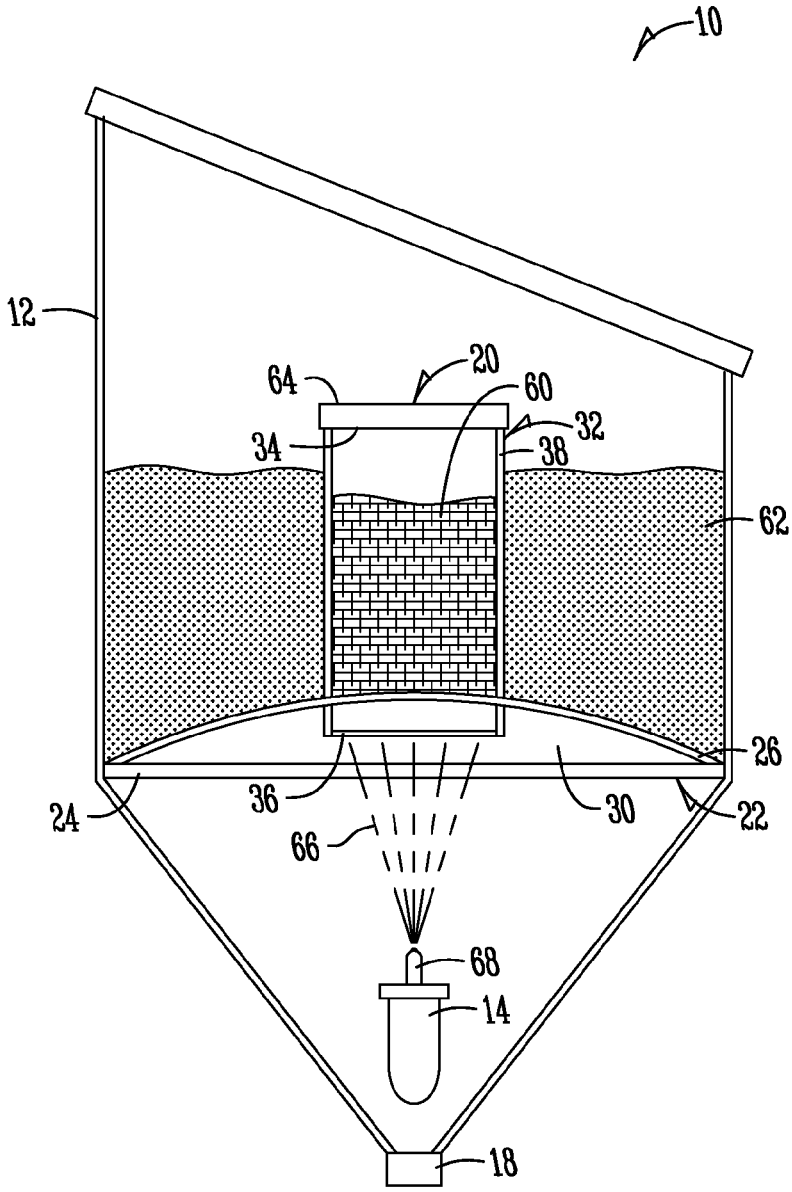
FIG. 5 is a sectional view of a detergent dispensing system using the apparatus of FIG. 2 showing a different spray pattern.
Figure 6:
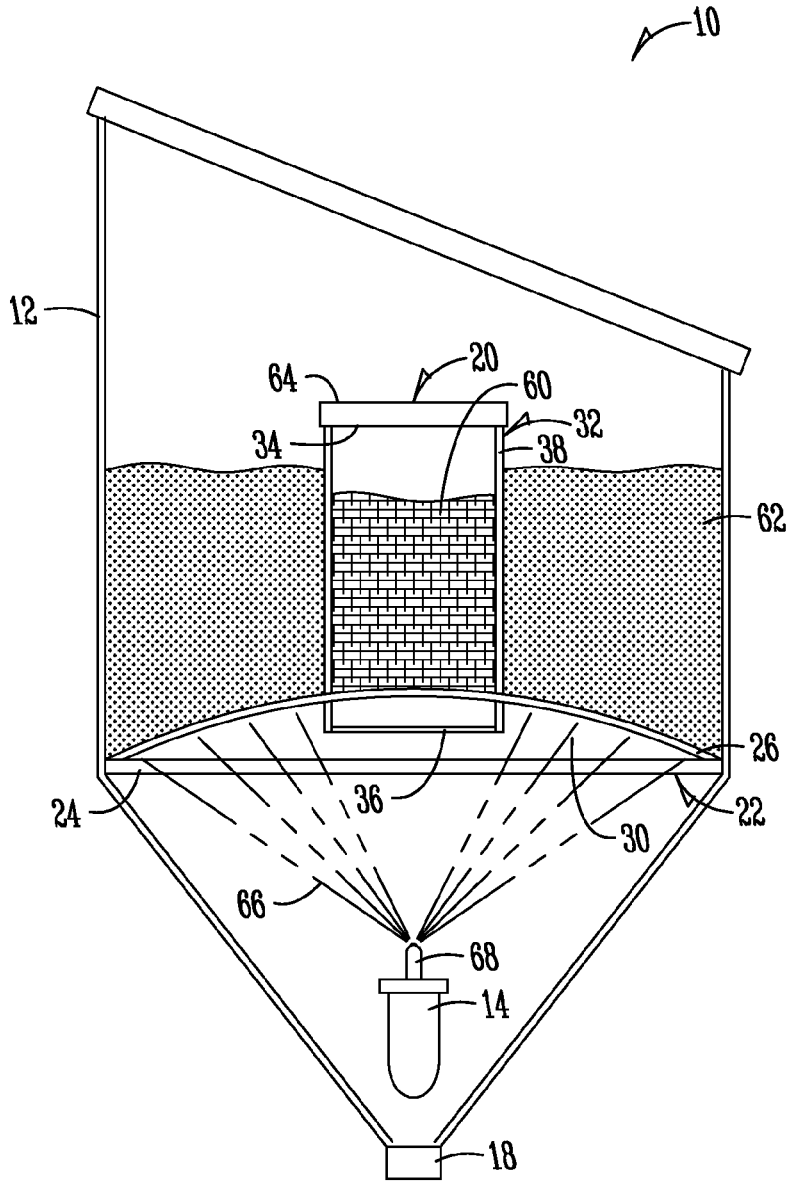
FIG. 6 is a sectional view of a detergent dispensing system using the apparatus of FIG. 2 showing yet another different spray pattern.

FIGS. 4-6 are sectional views of a dispensing system 10 that include the apparatus 20 of the present invention to separate a first product 60 and a second product 62 from reacting with one another during the use of the system. As one skilled in the art shall appreciate, any variation of the apparatuses disclosed herein may be utilized with the dispensing system 10 shown in the exemplary figures. The figures further depict different spray patterns 66 that may be used with the present invention.

An apparatus 20 is placed within the reservoir 12 of the dispensing system. It should be noted that the apparatus 20 used in FIGS. 4-6 is the same apparatus depicted in FIG. 2. A first product 60 is housed within the chamber 32, and a lid 64 is added to keep other substances from entering the chamber 22. A second product 62 is added to the reservoir 12 in the area around the chamber 32. The dome-shaped base 22 is formed by the inner support members 26 and the screen 30. The outer support member 24 rests in the reservoir and supports the apparatus 20. As is shown in FIGS. 4-6, the mesh of the screen 30 will hold the solid chemistries from falling below the screen 30.

To use the dispenser, water is sprayed in a spray pattern 66 from the nozzle 68 and upwardly towards the screen 30 and products 60, 62. The water will react with the products, which will drip downwardly due to gravity until they are dispensed out of the spout 18 and into the machine or apparatus for cleaning or storage unit (not shown) as applicable according to the methods of use of the invention. However, as the second end 36 of the chamber 32 is extended downwardly from the screen, it will create a fluid impervious barrier between the reacting first product 60 and second product 62. In addition, if the second end 36 is extendable, the length of the water impervious layer may be adjusted to accommodate different spraying patterns as well as different problems that may exist with splattering or "spray shadows," causing uneven erosion of the products 60, 62.

FIG. 4 shows a wide spray pattern 66 that sprays water on all of the products 60, 62 equally in terms of intensity and time. The reacting products will interact with one another as they are dispensed from the spout 18 and into the applicable machine or apparatus for cleaning or storage unit. Once sufficient volume and/or concentration of a cleaning use solution has been added to the machine or apparatus for cleaning or storage unit, the water is stopped in the water line 14, which causes the spray pattern 66 to stop. As soon as water stops contacting the products, no additional products 60, 62 are reacted and the uncontrolled reaction will terminate. The termination of the reaction is further ensured as a result of the chamber body separating the area inside and outside of the chamber 32.

FIGS. 5 and 6 shows additional spray patterns 66 that may be used with the apparatus 20 of the present invention. At times, it may be desired to add additional amounts of only one of the products to the machine. Therefore, as shown in FIGS. 5 and 6, the spray pattern 66 may be focused to spray water at the screen 30 only in the area where the first or second product is housed. FIG. 5 shows the nozzle 68 spraying water only at the first product 60 that is housed within the chamber 32. FIG. 6 shows a split spraying pattern 66 that is spraying water only at the screen 30 in the area outside the chamber 32 where the second product 62 is housed. The different spray patterns 66 allow for different amounts and different combinations of products to be added to the machine or apparatus for cleaning or storage unit. However, because the second end 36 of the chamber 32 is extended downwardly from the screen 30, it is assured that the spraying of one product will not cause the other product to be contacted with the water to initiate the chemical reaction and as a result be used up. Again, the chamber body 38 creates a fluid-impervious barrier between the two products, which may optionally further include a chamber lid 64 to close the first open end 34 of the chamber 32, to stop unwanted use or reacting of one or both of the products, which will extend the life of the products.

While FIGS. 4-6 show the use of an apparatus having only one chamber, as discussed above, it is possible to include the use of multiple chambers. The multiple chambers will provide additional housing for more products. As each of the multiple chambers includes a wall or barrier extending below the screen, none of the products will be able to contact any of the others. Therefore, the general principal of including a wall below the screen to aid in separating the products from one another is accomplished with one or many chambers. In addition, the spray patterns may be configured to focus on one, all, or a select combination of products when the apparatus includes multiple chambers. The use of multiple chambers according to the invention may further be desirable in order to custom fit solid product chemistries into preformulated shapes and sizes (as opposed to housing a second product 62 within the entire area around the chamber 22).

The invention has been shown and described above with the preferred embodiments, and it is understood that many modifications, substitutions, and additions may be made which are within the intended spirit and scope of the invention. The present invention is not to be limited to any specific embodiment described herein. For instance, the water pressure and temperature will be configured depending on the exact products used with the dispensing system. The mesh size and conformity of the screen may also be adjusted as required. Furthermore, as noted above, the apparatus may be dome shaped, flat, inverse dome shaped, or somewhere in between. The apparatus may also be generally dome shaped with a flat apex. In addition, in accordance with the invention, the solid products may take any variety of three dimensional configurations to fit inside the compartments within the apparatus, including for example cylindrical, cubic, spherical, and the like.

Solid Products for Use According to the Invention

Solid Formulations

According to the invention various solid chemistries may be used according to the apparatus of the invention. Preferably stable solid compositions are utilized, wherein a stable solid composition is one that retains its shape under conditions in which the composition may be stored or handled. According to the invention any solid chemistry can encompass a variety of forms, including for example, flowable solids, non-flowable solids (extruded or pressed), powders, flakes, pellets, blocks, tablets, lozenges, pucks, briquettes, bricks, granules and the like. Solid refers to the state of the products under the expected conditions of storage and use of the solid product with the apparatus and dispensing system according to the invention.

According to an embodiment of the invention, the solid chemistry products suitable for use according to the invention may be provided to the apparatus of the invention in a plastic jar or capsule. In contrast, an embodiment of a solid block of a composition can be provided as a dimensionally stable solid block without ajar or capsule.

According to a further embodiment of the invention, the solid chemistry products may be produced in a package that creates the physical barrier (i.e. above the screen 30) for the apparatus 20. This would enable the loading of solid products having different solid forms. In addition this would enable the packaging of solid products with its built-in screens to be fitted directly into the cylinder (or outside of the cylinder) based upon a user's matching of the shape and size of a cylinder with the shape and size of the solid product. As one skilled in the art will appreciate such custom fitting minimizes any errors in the intended placement of solid products into an apparatus within a dispensing system.

In certain embodiments, the solid products are provided in the form of a unit dose. A unit dose refers to a solid composition unit sized so that the entire unit is used during a single cycle or within a determined number of dispensing cycles. When the solid composition is provided as a unit dose, it can have a mass of for example about 1 g to about 50 g. In other embodiments, the composition can be a solid, a pellet, or a tablet having a size of about 50 g to 250 g, of about 100 g or greater, or about 40 g to about 11,000 g.

In other embodiments of the invention, the solid products are provided in the form of a multiple-use solid, such as, a block or a plurality of pellets, and can be repeatedly used to generate aqueous use solutions of the solid products for multiple cycles or a predetermined number of dispensing cycles. In certain embodiments, the solid products are provided as a solid having a mass of about 5 g to 10 kg. In certain embodiments, a multiple-use form of the solid products has a mass of about 1 to 10 kg. In further embodiments, a multiple-use form of the solid products has a mass of about 5 kg to about 8 kg. In other embodiments, a multiple-use form of the solid products has mass of about 5 g to about 1 kg, or about 5 g and to 500 g.

Regardless of the particular packaging of the solid products, the products are removed from any applicable packaging (e.g. film) and inserted directly into the dispensing apparatus according to the invention. Ideally, the solid products are formulated to closely fit the particular shape(s) of the dispensing system in order to prevent the introduction and dispensing of an incorrect solid product into the apparatus of the present invention.

Exemplary Chemistries Suitable for Use

Cleaning agents suitable for use according to the invention include two or more part chemistries wherein the solid surfaces react once contacted with water and result in continuous, uncontrolled reactions. For example, a peroxide source and a catalyst are a desirable formulation suitable for the present invention as a combined use solution creates bubbles for cleaning action. However, upon contact with a water source, the solid surfaces in contact with each other react in an uncontrolled manner, resulting in significant waste of material. Therefore it desirable to maintain a separation from the two solid surfaces in a dispensing system.

Active oxygen compounds providing a source of active oxygen may be included as a solid product used according to the apparatus and methods of the present invention. Active oxygen compound suitable for use according to the invention can be inorganic or organic, and can be a mixture thereof. Some examples of active oxygen compound include peroxygen compounds, and peroxygen compound adducts that are suitable for use in forming the binding agent. Many active oxygen compounds are peroxygen compounds, including for example hydrogen peroxide, group 1 (IA) active oxygen compounds (e.g., sodium peroxide), group 2 (IIA) active oxygen compounds (e.g., magnesium peroxide), group 12 (IIB) active oxygen compounds (e.g., zinc peroxide), group 13 (IIIA) active oxygen compounds (e.g., perborates), group 14 (IVA) active oxygen compounds (e.g., persilicates and peroxycarbonates), group 15 (VA) active oxygen compounds (e.g., perphosphates), group 16 (VIA) active oxygen compounds (e.g., peroxysulfuric acids and their salts), group VIIa active oxygen compounds (e.g., sodium periodate), and transition metal peroxides. Any of a variety of hydrogen peroxide and/or hydrogen peroxide adducts are suitable for use in the present invention.

Active oxygen compounds, including organic active oxygen compounds may also include peroxycarboxylic acids, such as a mono- or di-peroxycarboxylic acid, an alkali metal salt including these types of compounds, or an adduct of such a compound. Suitable peroxycarboxylic acids include $C_1$-$C_{24}$ peroxycarboxylic acid, salt of $C_1$-$C_{24}$ peroxycarboxylic acid, ester of $C_1$-$C_{24}$ peroxycarboxylic acid, diperoxycarboxylic acid, salt of diperoxycarboxylic acid, ester of diperoxycarboxylic acid, or mixtures thereof.

Catalysts may also be included as a solid product used according to the apparatus and methods of the present invention. Catalysts suitable for creating bubbles or bubbling of the use solution are preferred according to embodiments of the invention. In addition, catalysts suitable for converting or decomposing peroxides, peracids and active oxygen compound sources (i.e. oxidation) to generate bleaching radicals are preferred solid chemistries for use of the present invention. Non-limiting examples of catalysts may include transition metal groups, acidulants, such as inorganic acids, and the like.

Enzymes may also be included as a solid product used according to the apparatus and methods of the present invention. Enzymes are desirable for use according to the invention as a result of the need to protect enzymes from other chemistry in a cleaning solution until application. According to the invention it may be desirable to have one or more enzymes which provide activity for removal of protein-based, carbohydrate-based, or triglyceride-based stains from substrates; for cleaning, destaining, and presoaks. It is will appreciated that enzymes aid in various cleaning processes, such as the removal of starch and/or protein stains. Suitable types of enzymes include, but are not limited to: protease, an amylase, a lipase, a gluconase, a cellulase, a peroxidase, or a mixture thereof of any suitable origin, such as vegetable, animal, bacterial, fungal or yeast origin. Preferred selections are influenced by factors such as pH-activity and/or stability, thermostability, and stability to active detergents, builders and the like. In addition, enzyme selections are influenced by conditions of final utility, including the physical product form, use pH, use temperature, and soil types to be digested, degraded, or altered. Additional description of suitable enzymes may be obtained from "Industrial Enzymes", Scott, D., in *Kirk-Othmer Encyclopedia of Chemical Technology,* 3rd Edition, (editors Grayson, M. and EcKroth, D.) Vol. 9, pp. 173-224, John Wiley & Sons, New York, 1980.

Solid chemistries can further employ any of a variety of suitable binding agents. For example, in an embodiment, the present solids include a carbonate hydrate binding agent such as E-Form (described in U.S. Patents including U.S. Pat. Nos. 6,177,392; 6,150,324, 6,156,715, 6,258,765; each of which is incorporated herein by reference for disclosure of the binding agent). The present solids can include a binding agent based on a hydrated chelating agent, such as a hydrated aminocarboxylate (e.g., HEDTA, EDTA, MGDA, or the like) together with a carbonate hydrate. The present solids can include a binding agent based on a hydrated carboxylate, such as a hydrated citrate salt or a hydrated tartrate salt. The present solids can include a binding agent based on a hydrated polycarboxylate or hydrated anionic polymer. Another suitable binding agent is hydrated sodium hydroxide (i.e., caustic). These and other suitable binding agents will be readily appreciated by one of ordinary skill in the art to which the invention pertains.

Additional functional materials and/or additives may further be included according to the invention and dependent upon the particular active compounds in order that desirable properties are afforded to the particular solid product. For example, the functional material can afford desirable properties to the solid product such as enhancing solidification characteristics or dilution rate. The functional material can also, when dissolved or dispersed in an aqueous phase, provide a beneficial property to the aqueous material when used. Examples of functional materials include chelating/sequestering agent, alkalinity source, surfactant, cleaning agent, softening agent, buffer, anti-corrosion agent, bleach activators secondary hardening agent or solubility modifier, detergent filler, defoamer, anti-redeposition agent, antimicrobials, rinse aid compositions, a threshold agent or system, aesthetic enhancing agent (i.e., dye, perfume), lubricant compositions, additional bleaching agents, functional salts, hardening agents, solubility modifiers, enzymes, other such additives or functional ingredients, and the like, and mixtures thereof. Functional materials added to a composition will vary according to the type of composition being manufactured, and the intended end use of the composition.

Various other combinations of solidification, binding and/or use of hardening agents can be utilized in the solid products and formulations suitable for use according to the apparatus and methods of the present invention. Exemplary description is provided in the following U.S. patents which are incorporated herein by reference: U.S. Pat. Nos. 7,153,820; 7,094,746; 7,087,569; 7,037,886; 6,831,054; 6,730,653; 6,660,707; 6,653,266; 6,583,094; 6,410,495; 6,258,765; 6,177,392; 6,156,715; 5,858,299; 5,316,688; 5,234,615; 5,198,198; 5,078,301; 4,595,520; 4,680,134; RE32,763; and RE32818.

Methods of Use

Operation of the apparatus of the invention is relatively simple and is briefly described. According to an embodiment of the invention, a spray-type dispenser is used in order to impact a water spray upon an exposed surface of the two or more solid products to dissolve portions thereof. A concentrate use solution is obtained and thereafter dispensed to a storage reservoir or directly to a point of use, and optionally further diluted for a particular cleaning application. According to an embodiment of the invention, a ready to use solution is dispensed from a dispensing system, such as through a bottom dispenser configuration to a storage reservoir or a point of use. For example, a dispensing system may dose a use solution directly to an instrument washing sink, wherein the two part solid chemistry provides desirable bubbling for cleaning as a result of the peroxide and catalyst chemical reaction initiated upon dispensing from the apparatus and dispensing system according to the invention.

It is contemplated that the various cleaning compositions suitable for use according to the invention can be used in a broad variety of industrial, household, health care, vehicle care, and other such applications. Some examples include surface disinfectant, ware cleaning, laundry cleaning, laundry cleaning or sanitizing, bleaching with catalyzed peroxide, vehicle cleaning, floor cleaning, surface cleaning, pre-soaks, clean in place, and a broad variety of other such applications involving sanitizing and/or disinfecting.

The methods of use of the apparatus according to the invention may further vary according to the solid compositions and intended uses thereof, application of a water spray to the solid products (e.g., shape and angle of spray nozzle), surface area of the two or more solid products, melting point of the solids, hardness of the solids and any other alternations that may impact the relative dissolution rate of the solids to produce the desired use solution. For example, as one skilled in the art will appreciate the spray-type and pattern may vary depending upon the desired rate and extent of a chemical reaction required for a particular method of use according to the invention. For example, spay patters may be either intermit or continuous in the application of water. The solid products can then dissolve, for example, at a controlled or predetermined rate. According to an embodiment of the invention, the rate can be effective to maintain a concentration of dissolved products that are effective for a particular cleaning application.

All publications and patent applications in this specification are indicative of the level of ordinary skill in the art to which this invention pertains. All publications and patent applications are herein incorporated by reference to the same extent as if each individual publication or patent application was specifically and individually indicated by reference.

The inventions being thus described, it will be obvious that the same may be varied in many ways. Such variations are not to be regarded as a departure from the spirit and scope of the inventions and all such modifications are intended to be included within the scope of the following claims.

What is claimed is:

1. An apparatus for control of on-site mixing of at least a first and a second solid product, comprising:

a base having an outer support member and an aperture therethrough;

a screen attached to the base and substantially covering the base aperture;

a first chamber positioned at the base aperture, the first chamber having a first open end extending generally upward from the screen, an opposite second open end extending generally downward from the screen, and a chamber wall therebetween;

a fluid impervious layer between the inside of the first chamber and the area outside of the first chamber, wherein the chamber wall forms the fluid impervious; and a reservoir circumferentially surrounding the first chamber and above the screen, wherein the first solid product is housed in the first chamber between the screen and the first open end, and the second solid product is housed in the reservoir, wherein the chamber wall extends through the screen and the plurality of inner support members.

2. The apparatus of claim 1 wherein the base further comprises a plurality of inner support members extending from one portion of the outer support member to another portion of the outer support member across the aperture.

3. The apparatus of claim 1 wherein the screen, includes a first screen portion outside the first chamber and a separate second screen portion inside the first chamber, wherein the first and second screen portions are separated by the chamber wall.

4. The apparatus of claim 3 wherein the first screen portion and the second screen portion have mesh sizes that are different.

5. The apparatus of claim 1 wherein the base and screen comprise a dome shape.

6. The apparatus of claim 1 wherein the first chamber is configured to fluidly seal the area within the first chamber from the area outside the first chamber.

7. The apparatus of claim 1 further comprising a chamber lid configured to cover the first open end of the first chamber.

8. The apparatus of claim 1 wherein the distance between the screen and the second end of the first chamber is adjustable.

9. The apparatus of claim 1 wherein the first product is a catalyst and the second product is a peroxide source.

10. The apparatus of claim 1 further comprising a second chamber positioned at the base aperture, the second chamber having a first open end extending generally upward from the screen, an opposite second open end extending generally downward from the screen; and a chamber wall therebetween.

11. The apparatus of claim 1 wherein the first chamber further comprises a third open end fluidly sealed at the screen and a fourth open end fluidly sealed at the screen.

12. The apparatus of claim 11 wherein the screen is between the third open end and the fourth open ends of the chamber.

13. The apparatus of claim 12 wherein the third open end and the fourth open end of the chamber form a fluid impervious layer between the inside of the chamber and the area outside of the chamber.

14. An apparatus for control of on-site mixing of at least two solid chemistry products, comprising:

a base having an outer support member and an aperture therethrough;

a screen attached to the base and substantially covering the base aperture;

a first chamber positioned at the base aperture, the first chamber having a first open end extending generally upward from the screen and housing a first solid chemistry product, an opposite second open end extending generally downward from the screen, and a chamber wall therebetween;

a fluid impervious layer between the inside of the first chamber and the area outside of the first chamber, wherein the chamber wall forms the fluid impervious layer and extends through the screen and the plurality of inner support members;

a reservoir circumferentially surrounding the first chamber and above the screen, wherein the first solid chemistry product is housed in the first chamber between the screen and the first open end, and the second solid chemistry product is housed in the reservoir circumferentially surrounding the first chamber and above the screen; and wherein said first and second solid chemistry products are selected from the group consisting of a peroxide source, enzymes, catalysts and combinations of the same.

15. The apparatus of claim 14 wherein the first chamber is configured to fluidly seal the area the first chamber from the area outside the first chamber, such that when a water source is applied across the screen the first solid chemistry product dissolved does not come into contact with the second solid chemistry product until the second solid chemistry product is also dissolved and both products cross through the screen into a dispensing spout.

16. A method of using the apparatus of claim 1 for controlling on-site mixing of a two part solid chemistry product comprising: contacting a water spray onto a surface of said first and second solid chemistry products, wherein said first and second solid chemistry products are housed within the apparatus for controlling on-site mixing, and wherein said first and second solid chemistry products are selected from the group consisting of a peroxide source, enzymes, catalysts and combinations of the same.

17. The method of claim 16 wherein the surfaces of the first and second solid chemistry products contacted with the water spray are not in contact with one another until the first and second solid chemistry products are dissolved to form a concentrated use solution.

18. The method of claim 16 further comprising dispensing a concentrated use solution to a point of use or a storage reservoir and optionally including the step of diluting the concentrated use solution.

* * * * *